US008120536B2

(12) United States Patent
Lindmark

(10) Patent No.: US 8,120,536 B2
(45) Date of Patent: Feb. 21, 2012

(54) ANTENNA ISOLATION

(75) Inventor: Bjorn Lindmark, Sollentuna (SE)

(73) Assignee: Powerwave Technologies Sweden AB, Kista (SE)

( * ) Notice: Subject to any disclaimer, the term of this patent is extended or adjusted under 35 U.S.C. 154(b) by 335 days.

(21) Appl. No.: 12/422,165

(22) Filed: Apr. 10, 2009

(65) Prior Publication Data

US 2009/0256773 A1 Oct. 15, 2009

Related U.S. Application Data

(60) Provisional application No. 61/044,382, filed on Apr. 11, 2008.

(51) Int. Cl.
*H01Q 1/38* (2006.01)

(52) U.S. Cl. ..... 343/700 MS; 343/850

(58) Field of Classification Search ..... 343/700 MS, 343/846, 850

See application file for complete search history.

(56) References Cited

U.S. PATENT DOCUMENTS

| | | | | |
|---|---|---|---|---|
| 4,728,960 | A | 3/1988 | Lo | |
| 4,903,033 | A * | 2/1990 | Tsao et al. | 343/700 MS |
| 5,241,321 | A | 8/1993 | Tsao | |
| 5,448,250 | A | 9/1995 | Day | |
| 5,945,951 | A | 8/1999 | Monte et al. | |
| 6,018,320 | A | 1/2000 | Jidhage et al. | |
| 6,054,953 | A * | 4/2000 | Lindmark | 343/700 MS |
| 6,091,373 | A * | 7/2000 | Raguenet | 343/778 |
| 6,509,883 | B1 | 1/2003 | Foti et al. | |
| 6,515,628 | B2 * | 2/2003 | Roberts | 343/700 MS |
| 6,995,712 | B2 * | 2/2006 | Boyanov | 343/700 MS |
| 2005/0057396 | A1 | 3/2005 | Boyanov | |
| 2005/0200554 | A1 | 9/2005 | Chau | |

FOREIGN PATENT DOCUMENTS

| | | |
|---|---|---|
| EP | 0 847 101 | 6/1998 |
| WO | 98/33234 | 7/1998 |
| WO | WO 9931757 A1 | 6/1999 |
| WO | 00/01030 | 1/2000 |
| WO | 03/052868 | 6/2003 |
| WO | WO 2005107008 A1 | 11/2005 |

OTHER PUBLICATIONS

Swedish Patent Office Search Report for Application No. ITS/SE08/00126 dated Sep. 26, 2008.

European Search Report for application EP 09 44 5009 dated Jun. 26, 2009. Boyanov V., "Isolation improvement in dual port cross-slot coupled patch," Phased Array Systems and Technology, 2003, IEEE International Symposium on Oct. 14-17, 2003, Piscataway, NJ, USA, IEEE, Oct. 14, 2003 pp. 318-322, XP010676836, ISBN:978-0-7803-7827-8, the whole document.

Lindmark, B. et al., "Dual polarized multibeam antenna," Electronics Letters, IEE Stevenage, GB, vol. 35, No. 25, Dec. 9, 1999, 2 pages, XP006013070, ISSN: 0013-5194, the whole document.

* cited by examiner

*Primary Examiner* — Hoang V Nguyen
(74) *Attorney, Agent, or Firm* — OC Patent Law Group

(57) ABSTRACT

A dual polarized antenna element having improved antenna isolation is disclosed by the present invention. The antenna element includes a first feeder for feeding the antenna element in a first polarization direction, and a second feeder for feeding the antenna element in a second polarization direction. According to the present invention, a compensation line is arranged between the first and the second feeders for compensating for an imbalance caused by an essentially capacitive coupling between the first and second feeders. The compensation line is connected to the first and second feeders in close proximity to a radiating part of said antenna element, and has a short electrical length θ and a high impedance relative to an impedance of the first and second feeders, respectively, thereby giving the compensation line an essentially inductive character.

10 Claims, 10 Drawing Sheets

ANTENNA ISOLATION

RELATED APPLICATION INFORMATION

The present application claims the benefit under 35 U.S.C. §119(e) of the priority date of U.S. Provisional Patent Application Ser. No. 61/044,382 filed Apr. 11, 2008, the entire contents of which are hereby expressly incorporated by reference.

TECHNICAL FIELD

The present invention relates to a dual polarized antenna element and an antenna array, in which the antenna element includes:

- a first feeder for feeding the antenna element in a first polarization direction, and
- a second feeder for feeding the antenna element in a second polarization direction.

BACKGROUND OF THE INVENTION

Dual polarised or X-polarised antennas are today commonly used in cellular systems for mobile communication. The use of such antennas allows the use of polarisation diversity techniques to combat signal fading in the system. Compared to the use of vertical polarised antennas and space diversity techniques the number of antennas needed is reduced to half, which saves costs and reduces the size and the visual appearance of the antenna installations.

One important performance measure for dual polarised antennas is the isolation between the two antenna ports feeding the two polarisations. Typically, an isolation of more than 30 dB between the ports is wanted, which corresponds to a power coupling of less than 1/1000 between the ports.

An aperture coupled patch antenna element is a commonly used antenna type for dual polarised systems. In aperture coupled patch antenna elements, one or more metallic patches are fed by a micro strip feeding arrangement through a cross shaped aperture in a ground plane, as is shown in FIG. 1. Here, the antenna element 101 includes a radiating patch 103, fed through an aperture 109 by a microstrip feed line 105 positioned between a shielding cage 102 and a printed circuit board.

Isolation between a transmitting and a receiving signal path in a dual polarized antenna has been described in, for instance, prior art document U.S. Pat. No. 6,509,883. According to this document, a signal being transmitted from a first antenna element having one polarisation is received by a second antenna element having another polarisation, thereby causing an unwanted signal to be received by the second antenna element. In order to compensate for this, a compensation path is arranged between the transmitting and receiving signal paths, where the compensation path has a length such that the compensation signal travelling through the compensation path and the unwanted signal have equal magnitude and opposite phase when they meet in the receiving signal path.

Prior art solutions like the one described in U.S. Pat. No. 6,509,883, have a disadvantage in that they only compensate for signals having been transmitted from one antenna element and received by another antenna element. Thus, no solution is shown for solving the problem of capacitive coupling related to the feeders themselves.

In U.S. Pat. No. 6,509,883, the compensation path as well as the transmitting and receiving signal paths have to be adapted to have certain lengths in order to be able to cancel out the unwanted signal, having been transmitted from the first antenna and received by the second antenna, since a difference in length of an odd number of half wavelengths has to be present between the paths traveled by the unwanted signal and the compensation signal.

The prior art solution will therefore only cancel out this specific unwanted signal. Other unwanted signals, resulting from couplings other than this one, such as unwanted signals originating from capacitive coupling between the feeders in a point where the feeders are close to each other, will not be cancelled by the solution shown in this document, since the distinctive length requirements of the signal paths result in cancellation of the unwanted signal only if the unwanted signal and the compensation signal have traveled exactly those required lengths.

Also, a capacitive coupling between the feeders may take place at a very unfortunate point, for which a difference in length of an even number of half wavelength results between the paths traveled by the unwanted signal and by the compensation signal in U.S. Pat. No. 6,509,883. The compensation signal would in this case add to the unwanted signal instead of cancelling it.

Further, due to the signal path length requirements, the antenna element shown in this document has to have a certain size to achieve efficient cancellation, which is disadvantageous.

Thus, there is a problem in prior art relating to cancellation of different kinds of couplings being present in a dual polarized antenna element.

SUMMARY OF THE INVENTION

It is an object of the present invention to provide a dual polarised antenna element that solves the above stated problems.

The present invention aims to provide a dual polarised antenna element, which offers improved antenna isolation for all kinds of essentially capacitive couplings between the feeders. The present invention thus aims to provide compensation for capacitive coupling between the feeders, also including a capacitive coupling occurring via the radiating part, for example a radiating patch, of the antenna element.

According to an embodiment of the present invention, the object is for a dual polarized antenna element achieved by the use of:

- a compensation line being arranged between the first and the second feeders for compensating for an imbalance caused by an essentially capacitive coupling between the first and second feeders, where
- the compensation line is connected to the first and second feeders in close proximity to a radiating part of the antenna element, and has a short electrical length $\theta$ and a high impedance relative to an impedance of the first and second feeders, respectively, thereby giving the compensation line an essentially inductive character.

The object is also achieved by an antenna array including at least two such dual polarized antenna elements.

Thus, the present invention achieves compensation of mutual coupling in dual polarized antenna elements using a compensation line being connected between the input ports. When this compensation line is short in relation to the wavelength, this connection will act as an inductive element well suited to compensate for the capacitive mutual coupling in the antenna element.

The dual polarised antenna element according to the present invention has the advantage that it can provide good antenna isolation through an efficient compensation for essentially all types of capacitive coupling between the feeders in the antenna element, including capacitive coupling between the feeders and the radiating part of the antenna element. The compensation is achieved by the use of a compensation line, which is small in size, not costly to produce, easy to implement and which efficiently cancels out the capacitive coupling being present by its inductive character.

According to an embodiment of the present invention, the dual polarized antenna element is of the aperture coupled patch antenna type. Each feeder here includes a pair of feed lines extending along slots of a cross shaped aperture such that the feed lines cross each other at a mutual distance, resulting in a capacitive coupling between the feeders. Such a crossing can be arranged as an air-bridge. In the antenna element according to this embodiment, this capacitive coupling is cancelled by the high impedance connection between the feeders.

Detailed exemplary embodiments and advantages of the antenna elements and antenna arrays of the present invention will now be described with reference to the appended drawings illustrating some preferred embodiments.

DETAILED DESCRIPTION OF THE INVENTION

Dual polarized antenna elements commonly suffer from imbalance due to mutual coupling for various reasons. Even though an antenna element may show a geometrical symmetry to a large extent, including the radiating part and the majority of the feed network, we typically have one or more points of asymmetry causing mutual coupling.

Figure 1:
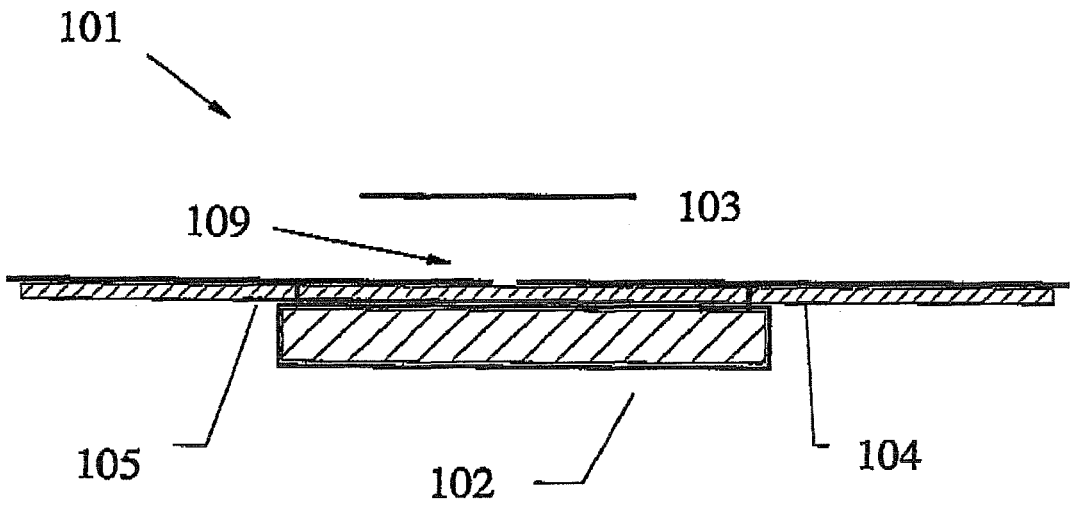
FIG. 1 shows a prior art aperture coupled patch antenna element.
Figure 2:
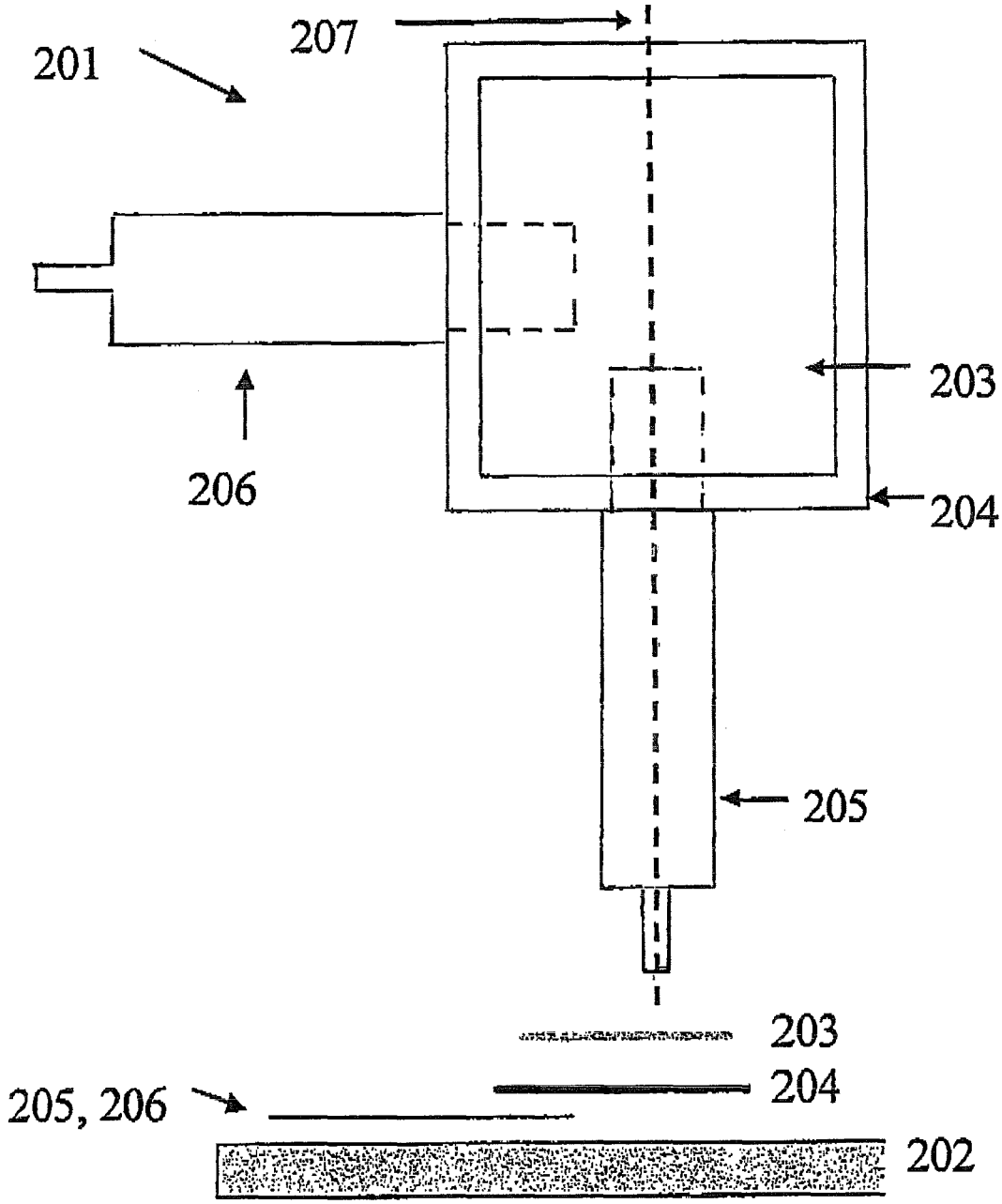
FIG. 2 shows an unbalanced prior art antenna element.

FIG. 2 shows one example of this for a patch antenna element including a ground plane 202, a top patch 203 and a lower patch 204. Here, an electromagnetically coupled patch element is fed by two orthogonal feeders 205, 206, both with a capacitive coupling to the two stacked patches. The antenna element is here not symmetrical, since the feeder connections are not symmetrical. For example, if we look into the element along for example the feeder 205 at the bottom of the figure, we see that only one side (the left side) of the other sides of each patch is loaded by another feeder 206, while the other sides (for instance the right side) have an open circuit. Thus, the antenna element is not symmetrical around the plane of the dashed line 207, since there is no feeder connection at the right side of the antenna element.

Figure 3A:
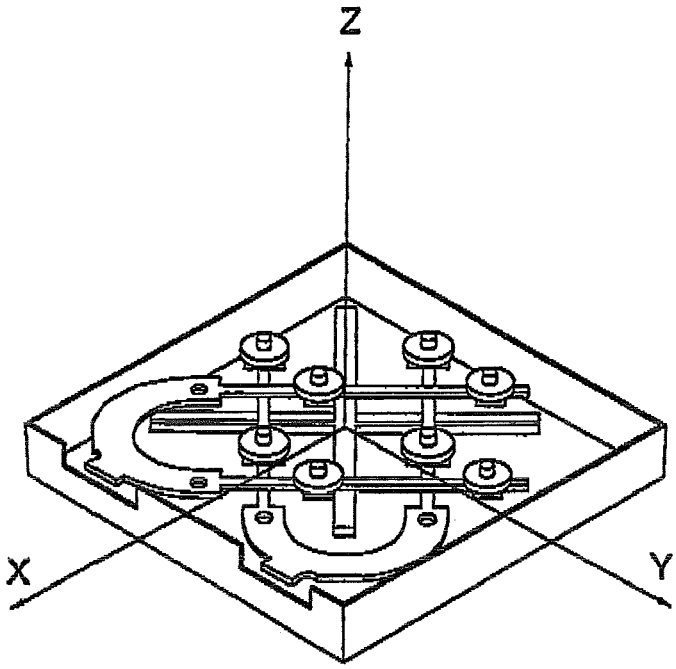
FIGS. 3*a-b* show unbalanced prior art antenna elements.
Figure 3B:
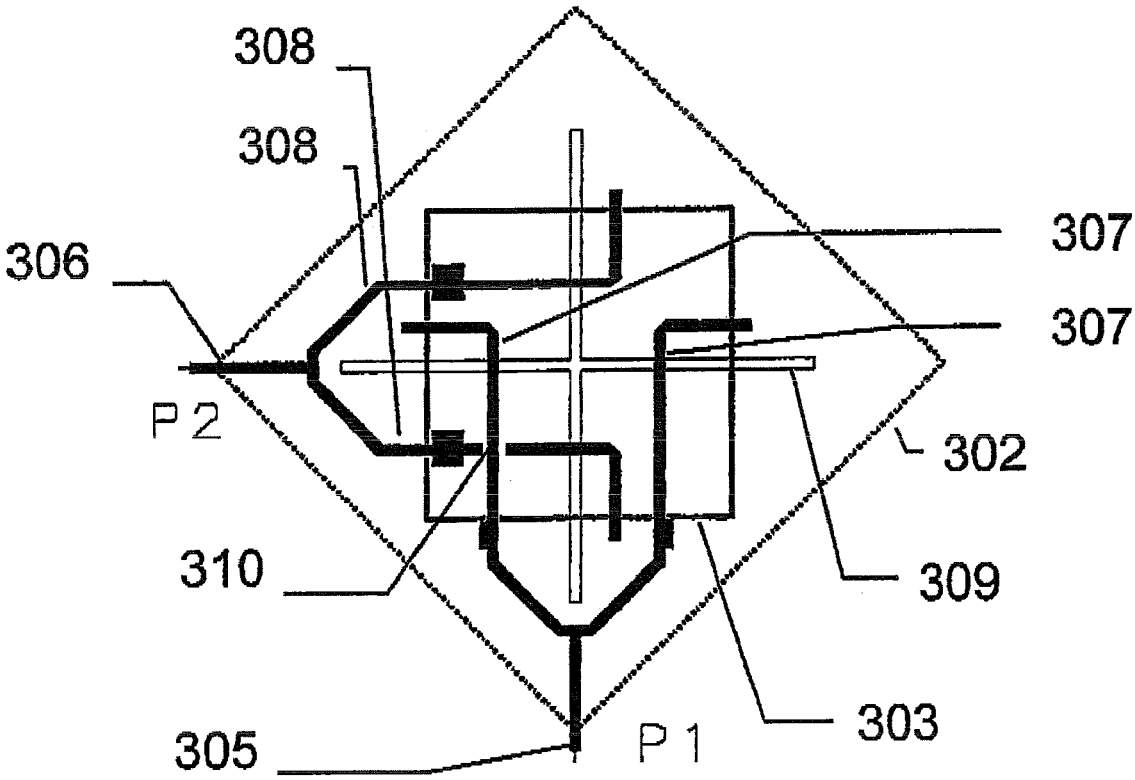

In FIG. 3*a*, and more in detail in FIG. 3*b*, an aperture coupled patch antenna element 301 having a shielding cage 302 for back radiation and a cross-shaped aperture 309 is disclosed. Here, each of the feeders 305, 306, feeding a polarization, respectively, includes a pair of feed lines 307, 308 extending in parallel along the cross shaped aperture 309, respectively, such that a two of those feed lines cross each other in one point 310. Because of the symmetrical shape of the micro strip feeders, including the feed lines, each feeding one polarisation, they need to cross each other in at least one point 310, as can be seen in FIGS. 3*a* and 3*b*. This at least one crossing 310 is typically achieved by using an air bridge for one of the polarizations. This air bridge crossing destroys the symmetry of the antenna element and imposes a capacitive coupling between the two feeders 305, 306.

Thus, in both of the cases shown in FIGS. 2 and 3, there is an asymmetry present, which will cause mutual port-to-port coupling between the port P1 and the port P2 of the feeders. This mutual coupling and its corresponding imbalance have to be mitigated in order to achieve efficient antenna isolation.

According to the present invention, as will be described more in detail below, it has been discovered that such mutual coupling between the feeders often is of essentially capacitive character. From this finding, it has further been realized that an element having an essentially inductive character connected between the feeders could be used for reducing the mutual coupling between the feeders.

Figure 4A:
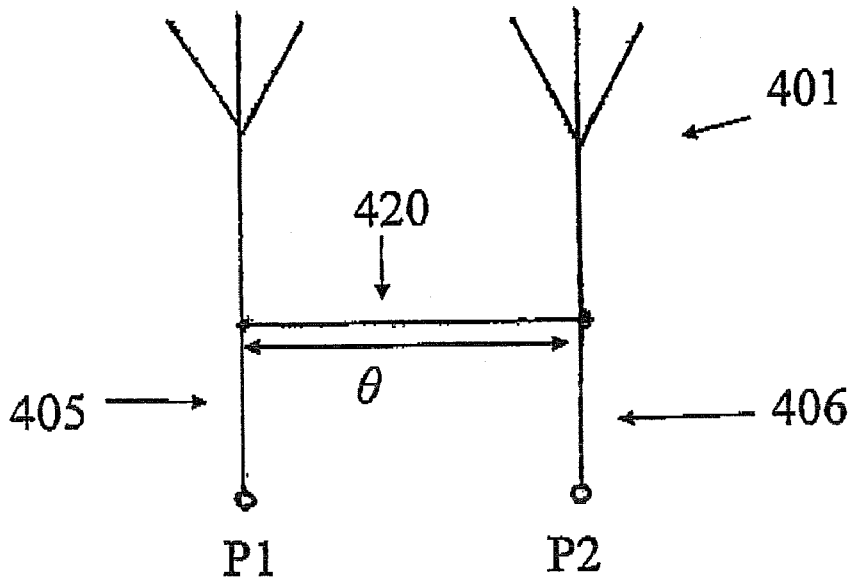
FIGS. 4*a-c* schematically show dual polarized antenna elements according to the present invention.
Figure 4B:
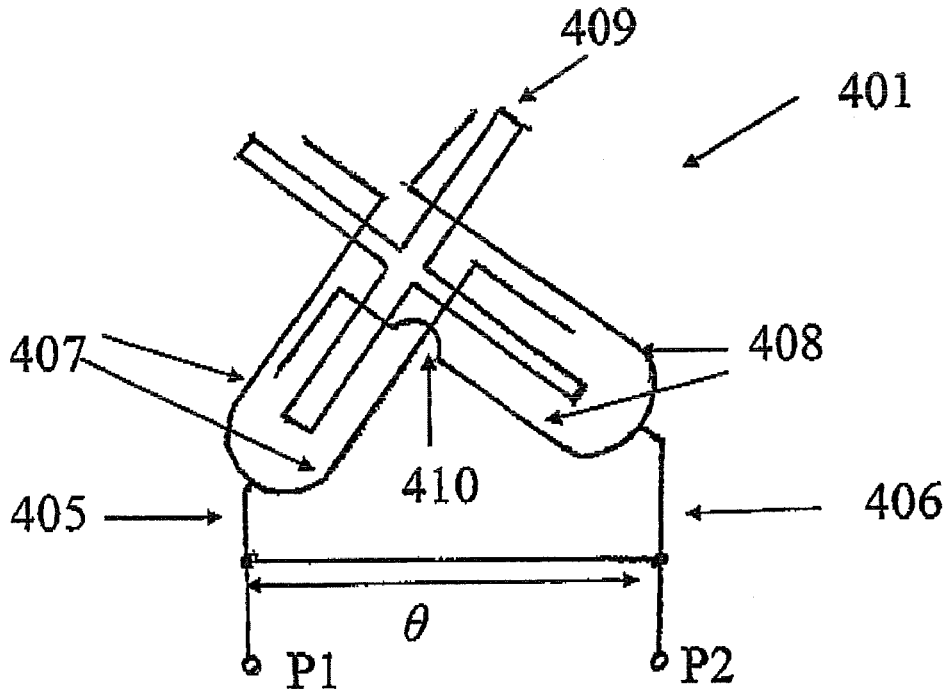
Figure 4C:
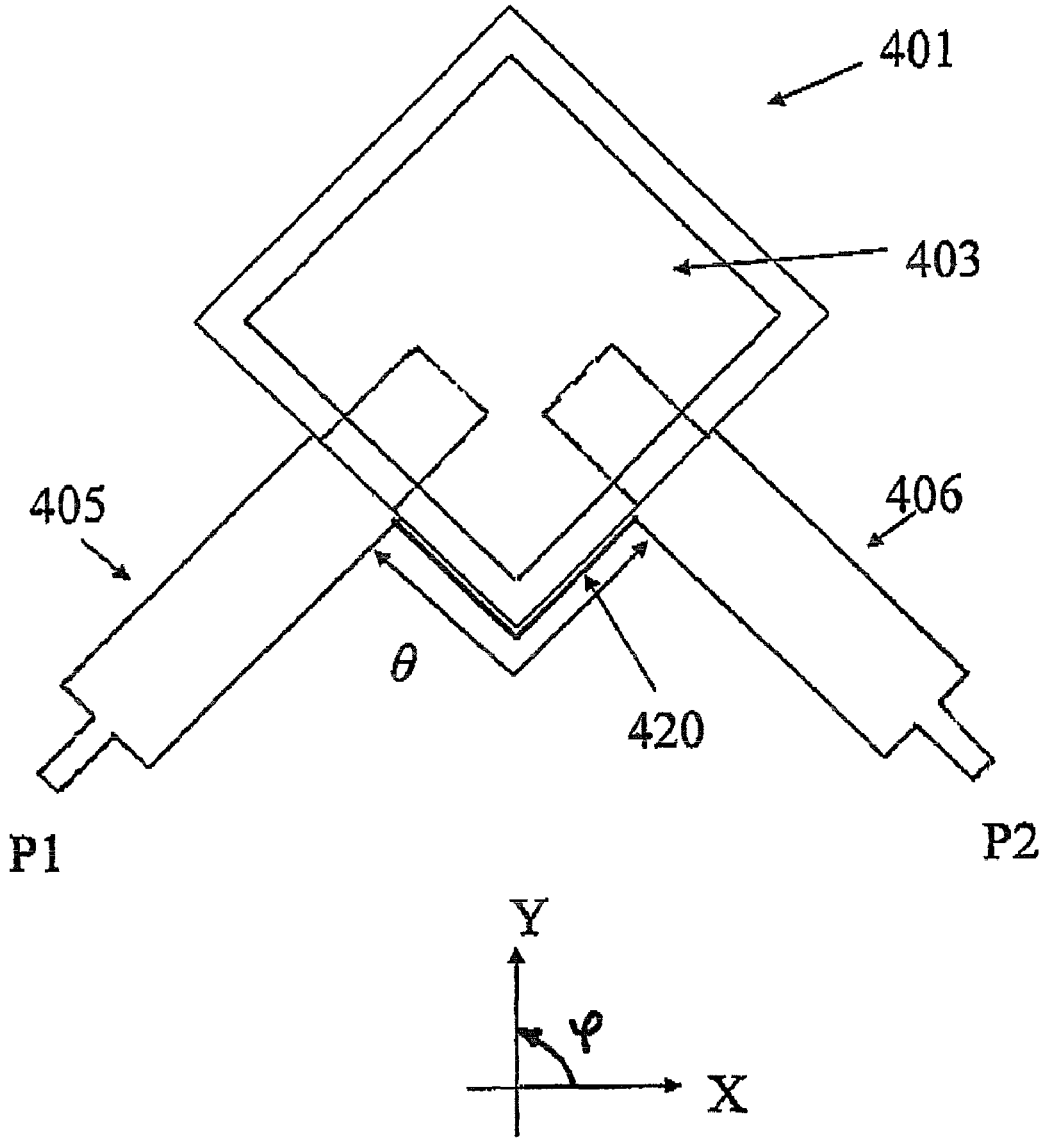

In FIGS. 4*a*-4*c*, three different types of dual polarized antenna elements according to different embodiments of the present invention are shown schematically. (Reference numbers are here only given to parts that are needed for explanation of the present invention.) These antenna elements 401 are dual polarized antenna elements and include a first feeder 405 for feeding said antenna element 401 in a first polarization direction. The first feeder 405 has a connection port P1. The antenna elements 401 further have a second feeder 406 for feeding said antenna element 401 in a second polarization direction, also being provided with a connection port P2.

FIG. 4*a* schematically illustrates a general dual polarized antenna element 401, being fed by two feeders 405, 406, having mutual coupling between them.

As shown in FIG. 4*b*, for the case that the antenna element 401 is an aperture coupled patch antenna element having a cross-shaped aperture, each one of the feeders 405, 406 includes a pair of feed lines 407, 408 extending in parallel along the cross shaped aperture 409, on each side thereof, respectively, such that two of those feed lines 407, 408 cross each other in one point 410, typically being arranged as an air bridge. Such an antenna structure could also result in more than one crossing of feed lines, depending on the shape of the feed lines.

According to the present invention, in order to compensate for the imbalance resulting from the mutual coupling between the feeders, a compensation line 420 is arranged between said first and said second feeders 405, 406. The compensation line 420 should be connected to the first and second feeders 405, 406 in a point on each of the feeders that is in close proximity to a radiating part of the antenna element.

As was stated above (and will be proven below), the mutual coupling between the feeders is of an essentially capacitive character and can be cancelled by the compensation line 420, if the compensation line 420 has an essentially inductive character. This is, according to the present invention, achieved by arranging the compensation line 420 such that its electrical length θ is short and that it is thin such that it has high impedance relative to an impedance of the first and second feeders 405, 406. These characteristics of the compensation line 420 make the compensation line essentially inductive.

More in detail, as will be shown below, in order to achieve an inductive character for the compensation line 420, the electrical length θ of the compensation line 420 should be small, preferably being less than 2π/3 rad, thus θ<2π/3 rad. However, as is clear to a skilled person, also other lengths than this could be advantageous for different implementations.

Also, the compensation line 420 should have an impedance that is at least twice as high as the impedance for the feeders 405, 406. The electrical length θ is, as is well known for a person skilled in the art, a length that is related to the wavelength of the signal being transmitted.

Thus, by the compensation line 420 according to the present invention, being connected between the first and second feeders 405, 406, a novel method of coupling the polarisations together via an essentially inductive connection is used, in such way that the magnitude and phase of this coupling cancels the mutual coupling in other parts of the antenna element. Thereby, a required isolation level is achieved at low cost, which is small in size and easy to implement.

In FIG. 4*c*, for a dual polarized patch antenna, the compensation line 420 is implemented by a high impedance microstrip line in close proximity of the radiating patch 403. In order to have an inductive character, the compensation line 420 should have a short electrical length θ and have an impedance, which is much higher than the impedance for the feeders. For example, the feeders 405, 406 can have an impedance of around 50Ω, whereas the compensation line has an impedance of around 220Ω.

The compensation line is connected to the first feeder 405 at a first distance $D_1$ from the radiating part of the antenna element, for instance a radiating patch. The compensation line is also connected to the second feeder 406 at a second distance $D_2$ from the radiating part. According to an embodiment of the present invention, the first and second distances should be very short relative to the wavelength of the transmitted signal. The first and second distances should preferably be much less than half of the wavelength of the transmitted signal, and more preferably much less than a quarter of the wavelength of the transmitted signal, in order to efficiently cancel the capacitive coupling between the feeders. Thus, preferably $D_1 \ll \lambda/2$ and $D_2 \ll \lambda/2$, and more preferably $D_1 \ll \lambda/4$ and $D_2 \ll \lambda/4$.

By the use of such a compensation line, having an inductive character, the capacitive coupling between the feeders is cancelled, as will be shown in the following.

Such a capacitive coupling can occur in any situation where a feeder or a feed line of one polarization is close to a feeder or a feed line of another polarization. Such a situation can thus occur in an air-bridge, but also somewhere else in the antenna element, where feeders run in close distance to each other. Also, as is exemplified below, there can be a capacitive coupling between one or both of the feeders and the radiating part of the antenna.

It will now be shown that a mutual coupling between the feeders, including coupling between the feeders and the radiating parts of the two polarizations, often is of capacitive character and that this mutual coupling can be cancelled by the use of a compensation line between the feeders having an essentially inductive character.

Figure 5:
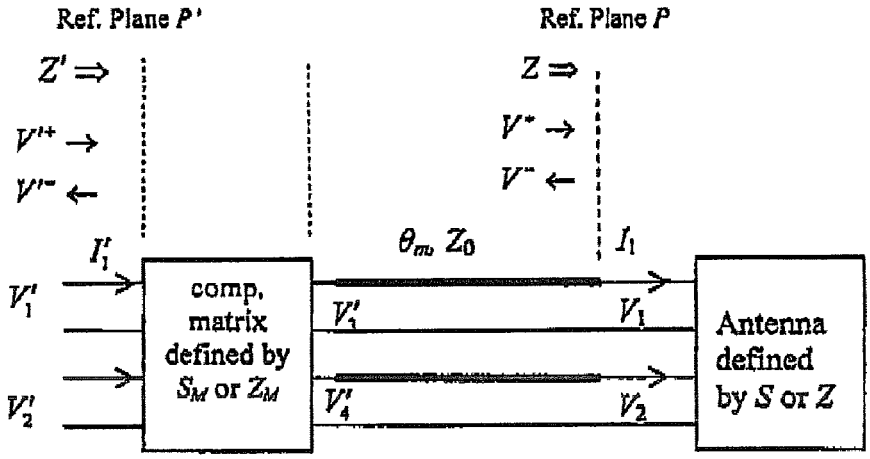
FIG. 5 schematically illustrates mutual coupling.

A general description of mutual coupling in a radiating part is shown in FIG. 5. An antenna element with two input ports is represented by a scattering matrix S or by an impedance matrix Z, both being of the dimension 2×2. Each port here corresponds to one of the two orthogonal polarizations of the radiated wave.

The scattering matrix S provides the relationship between ingoing voltage waves (plus sign) and outgoing voltage waves (minus sign) on the ports:

$$V^- = SV^+ \tag{1}$$

The impedance matrix Z determines the ratio between voltage vector V and current vector I on the lines:

$$V = ZI \tag{2}$$

If all ports have the same characteristic impedance $Z_0$, these are related by the following well-known matrix equation:

$$Z = Z_0(E+S)(E-S)^{-1}$$

$$S = (Z+Z_0E)^{-1}(Z-Z_0E)' \tag{3}$$

where E is the identity matrix.

In particular, from the matrix equation (3) it follows that the mutual coupling between the two ports 1 and 2, $S_{21}$, is related to the mutual impedance as:

$$S_{21} = \frac{2Z_{21}Z_0}{(Z_{11}+Z_0)(Z_{22}+Z_0)-Z_{12}Z_{21}} \tag{4}$$

Further, in FIG. 5 we have a second 2×2 matrix defined by $S_M$ or $Z_M$. When analyzing FIG. 5, it is clear that we, in general, can design a loss-less matrix $S_M$ such that the coupling from port 1' to 2' is zero. This could be done by using, e.g., a directive coupler.

In accordance with the present invention, we will here study a special case of cross-polar coupling in the antenna element, which is the case when this coupling is a result of a capacitance between the feeders and the radiating parts of the two polarizations. This is illustrated in FIGS. 6*a* and 6*b*.

In general, the mutual coupling often includes capacitive coupling between at least one of the first and second feeders and the radiating part, here being a patch, of said antenna element.

Figure 6A:
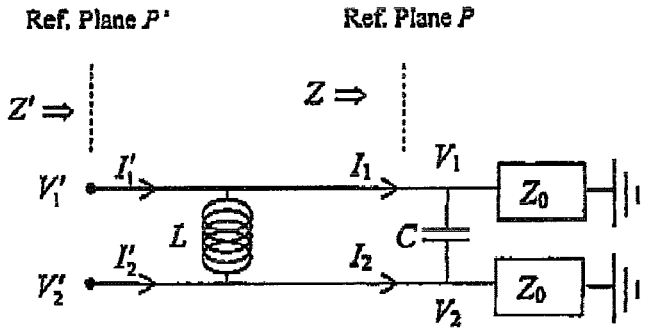
FIGS. 6*a-b* schematically illustrates capacitive mutual coupling.

FIG. 6*a* shows an antenna element defined by a matrix Z with mutual coupling represented by a capacitance C. Note that the ground reference line in FIG. 5 here has been removed for clarity. FIG. 6*a* also shows a compensation connection in the form of an inductance L, in accordance with the present invention.

Figure 6B:
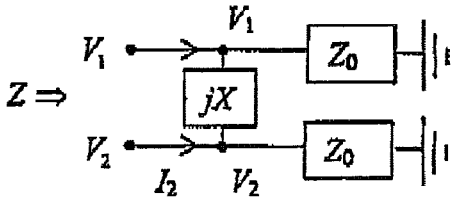

FIG. 6*b* shows the antenna element from FIG. 6*a*, but with the two shunt loads, corresponding to the mutual coupling and the compensation connection, being represented by a single load $$jX = j\omega L + 1/j\omega C,$$

and Z' being replaced by Z.

Here, the elements of the impedance matrix Z can be determined from circuit theory as:

$$Z_{11} = Z_{22} = \frac{V_1}{I_1}\Big|_{I_2=0} = Z_0 // (Z_0 + jX) = \frac{Z_0^2 + jXZ_0}{2Z_0 + jX} \tag{5}$$

and by performing voltage division and (5):

$$Z_{12} = Z_{21} = \frac{V_2}{I_1}\Big|_{I_2=0} = \frac{Z_0}{(Z_0+jX)}\frac{V_1}{I_1}\Big|_{I_2=0} = \frac{Z_0(Z_0^2+jXZ_0)}{(Z_0+jX)(2Z_0+jX)} = \frac{Z_0^2}{2Z_0+jX}. \quad (6)$$

Substitution of (5-6) in (4) gives:

$$S_{21} = \frac{2Z_0^2}{(2Z_0+jX)}\frac{(2Z_0+jX)}{(Z_0^2+jXZ_0+Z_0(2Z_0+jX))^2-Z_0^4} = \frac{2Z_0^3(2Z_0+jX)}{(3Z_0^2+j2XZ_0)-Z_0^4} = \frac{Z_0(2Z_0+jX)}{4Z_0^2+j6XZ_0-2X^2}. \quad (7)$$

Equation (7) shows that, in order to have zero coupling when X is real, we need to have $X \to \infty$.

Since jX is a parallel circuit we have:

$$jX = \frac{1}{j\omega C + \frac{1}{j\omega L}} = \frac{j\omega L}{1-\omega^2 LC} \quad (8)$$

Note here that, from a feeder input port point of view, the capacitive mutual coupling and the compensation line together form a parallel resonance circuit.

Thus, the solution is the well-known resonance condition:

$$L = \frac{1}{\omega^2 C} \Rightarrow X \to \infty \text{ and } S_{21} = 0.$$

Therefore, the mutual coupling can be cancelled by the use of a compensation line between the feeders having an inductive character.

In the following, it will be shown that this inductive compensation line can be implemented as a connection between the feeders having a short electrical length and being thin, such that it has a high impedance in relation to the feeder impedance.

We have seen above that mutual coupling from a capacitance can be compensated by adding an inductive element between the feeders. At microwave frequencies (e.g. above 1 GHz), this is preferably done by using for example a transmission line rather than discrete components. An illustration of the use of such a transmission line is shown in FIGS. 4*a-c*.

Since the characteristic impedance of a transmission line is $$Z_c = \sqrt{\frac{L}{C}},$$

a high impedance transmission line should correspond to a large inductance.

Figure 7A:
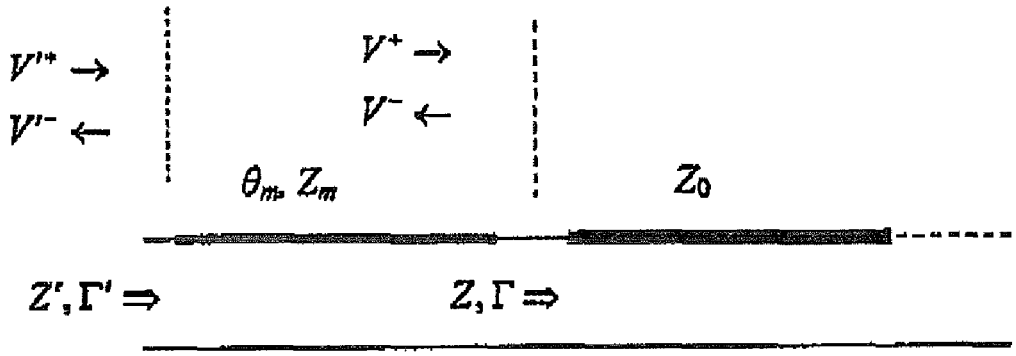
FIGS. 7*a-b* illustrates transmission line impedances.
Figure 7B:
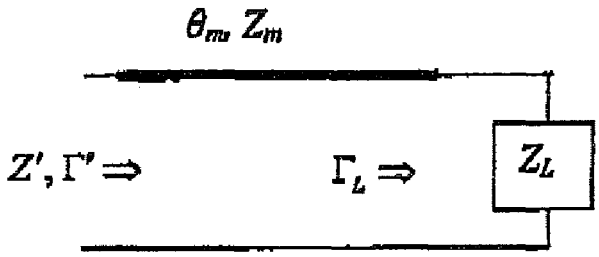

The question is then in which sense such a thin transmission line may be seen as the discrete element required by equation (7) above. Consider the transmission line shown in FIG. 7. In FIG. 7*a*, a high impedance transmission line of electrical length θ is connected to a line with the system impedance $Z_0$. In FIG. 7*b*, a general case is shown.

The input impedance Z' at the beginning of the high impedance line is related to the impedance of the load $Z_L$ by the well-known transmission line formula:

$$Z' = Z_m \frac{Z_L + jZ_m \tan\theta}{Z_m + jZ_L \tan\theta} \quad (9)$$

If the high impedance transmission line is short, i.e. θ<<1 rad, we may approximate equation (9) as:

$$Z' \approx Z_m \frac{Z_L + jZ_m\theta}{Z_m + jZ_L\theta} = Z_m \frac{Z_L Z_m + j(Z_m^2+Z_L^2)\theta + Z_L Z_m \theta^2}{Z_m^2 + Z_L^2\theta^2} \approx Z_L + j\theta\frac{Z_m^2+Z_L^2}{Z_m}, \quad (10)$$

where we have used tan θ≈ sin θ≈θ and then dropped the $\theta^2$-terms. From equation (10), it is clear that the effect of a short high impedance line is to add a positive series reactance. If the line is very thin so that the impedance is very high, the total impedance is simply:

$$Z' \approx Z_L + jZ_m\theta \quad (11)$$

Thus, by connecting a compensation line between the feeders, an inductive element between the feeders is added, if the compensation line has a short electrical length θ and a high impedance in relation to the impedance of the feeders.

Thus, as was deducted above, such a high impedance inductive compensation line cancels the mutual coupling between the feeders. High impedance here means high impedance relative to the impedance of the feeders used for feeding the polarizations.

In connection with equation 10 above, it is, for pedagogic reasons, stated that the electrical length θ of the compensation line should be much less than 1 rad, in order to a result in an approximated expression. However, for practical implementations, according to one embodiment of the invention, the electrical length θ should preferably be less than 2π/3 rad, thus θ<2π/3 rad. This electrical length also results in a compensation line having an essentially inductive character.

Also, as is clear for a skilled person studying equations 10-11 and FIG. 5, different electrical lengths θ of the compensation line, having an essentially inductive character, can be suitable for different implementations of the invention. Therefore, according to an embodiment of the present invention, the electrical length θ of the essentially inductive compensation line is longer than 2π/3 rad.

As non-limiting numerical examples, the feeders can have an impedance of 50Ω, and the compensation line can have an impedance of more than twice the feeder impedance, for instance 220Ω. The compensation line can, for instance, be implemented as a 0.5 mm wide microstrip line. Further, the patches can have a size of, for instance, 66 mm or 56 mm.

The antenna element of the present invention has been designed and simulated for signals in the frequency interval 1800 MHz to 2200 MHz. The inventive idea of the present invention may, however, also be implemented in other frequency intervals, as is clear to a skilled person.

Further, according to an embodiment of the present invention, dual polarised antenna elements of the present invention are arranged in an antenna array. Here, the two polarisations of two patches of two antenna array elements are each fed by a first feeder and a second feeder. According to the embodiment of the invention, there is arranged a compensation line between the first and second feeders in close proximity of each of the patches, respectively, thereby enhancing the antenna isolation of the antenna elements of the array. As is clear to a skilled person, such an antenna array can include essentially any number of dual polarized antenna elements according to the present invention.

Also, according to an embodiment of the present invention, the antenna isolation of the present invention is combined with other techniques for improving antenna isolation, being any one of the techniques of parasitic impedances and/or shield wall and/or asymmetrical/rectangular patches and/or diagonal apertures and/or shifted feed positions. Such a combination has the advantage of even further enhancing the level of isolation.

As is obvious for someone skilled in the art, the present invention can be used on essentially any dual polarised antenna element, although, for illustrational reasons, it is mainly described in terms of patch antennas, such as aperture coupled patch antennas, in this specification.

Figure 8A:
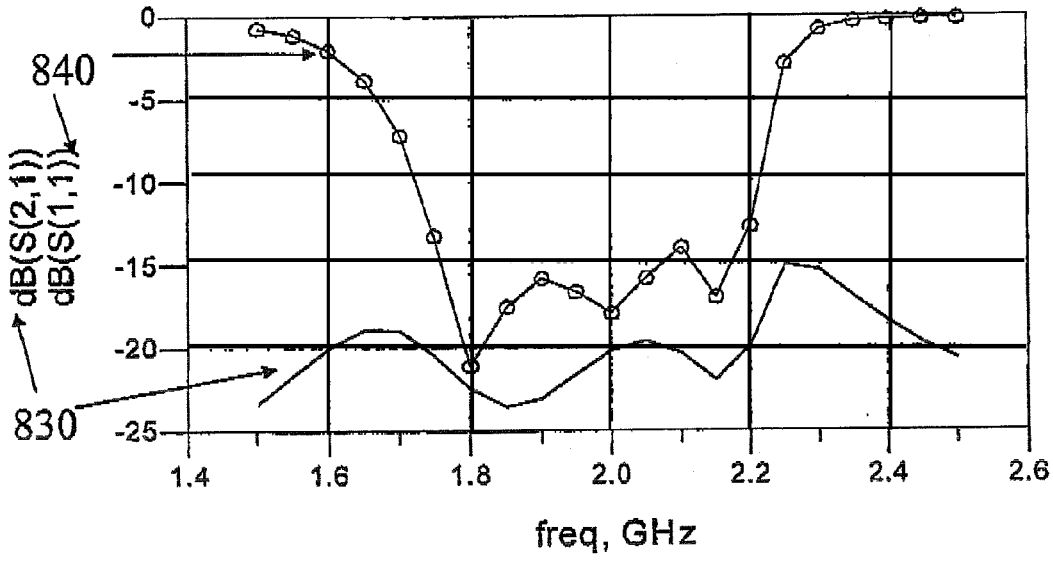
FIGS. 8*a-b* show simulations for a prior art antenna element (a), and for an antenna element according to the present invention (b).
Figure 8B:
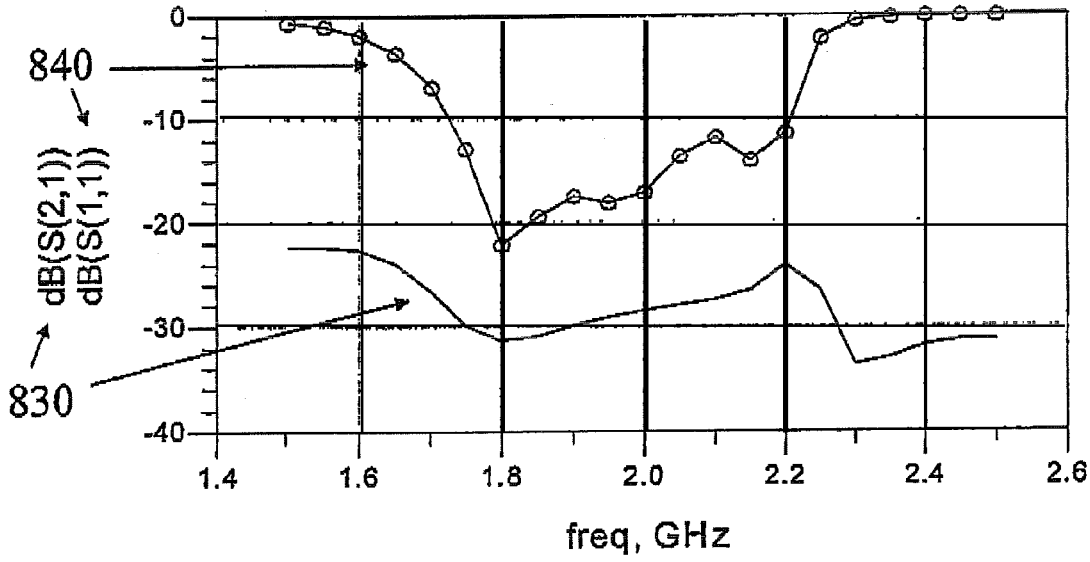
Figure 9A:
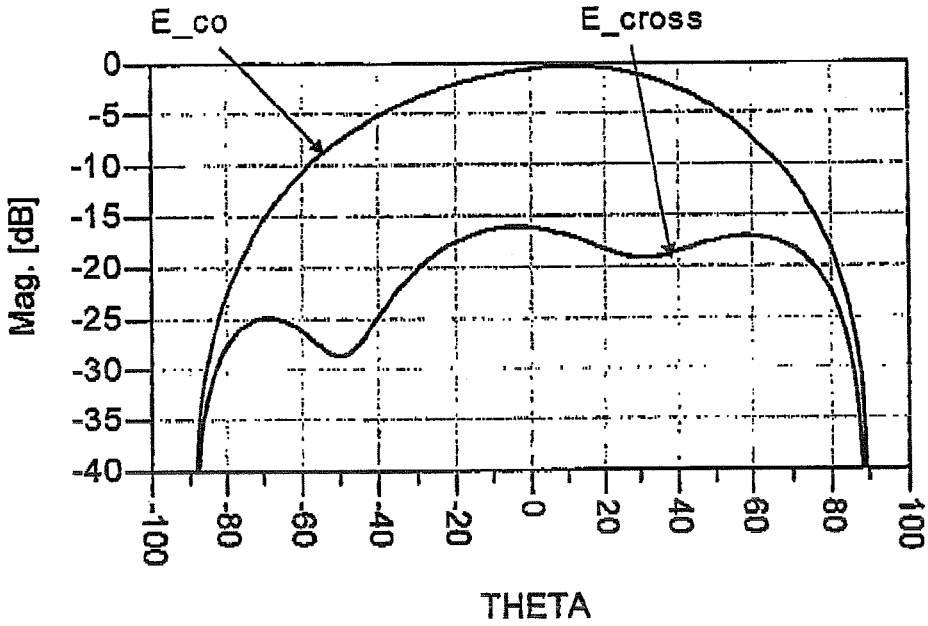
FIGS. 9*a-b* show simulations for a prior art antenna element (a), and for an antenna element according to the present invention (b).
Figure 9B:
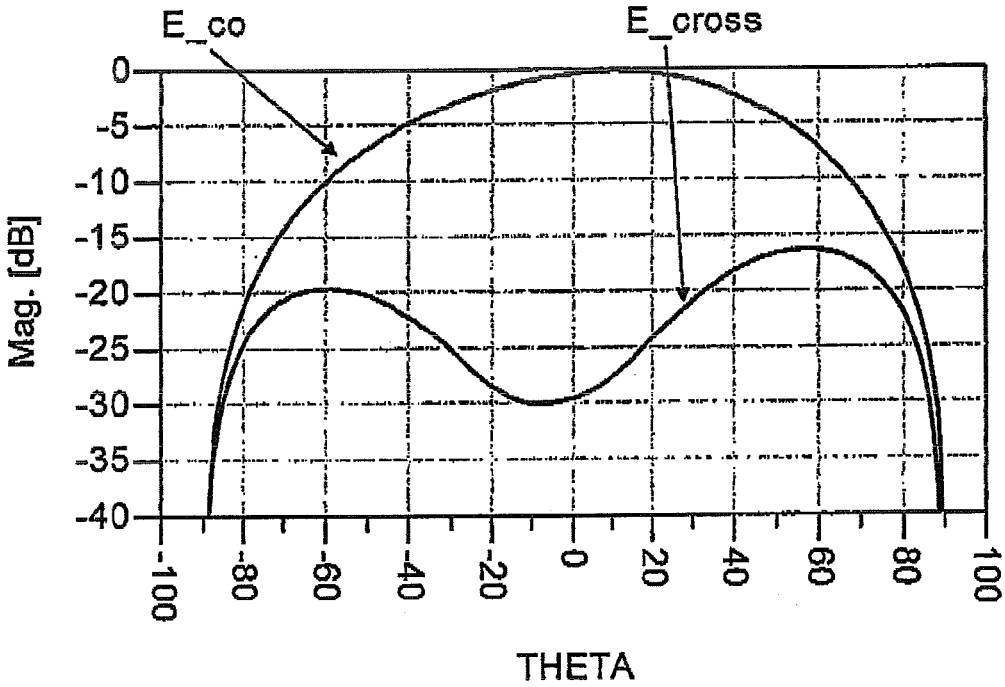
Figure 10A:
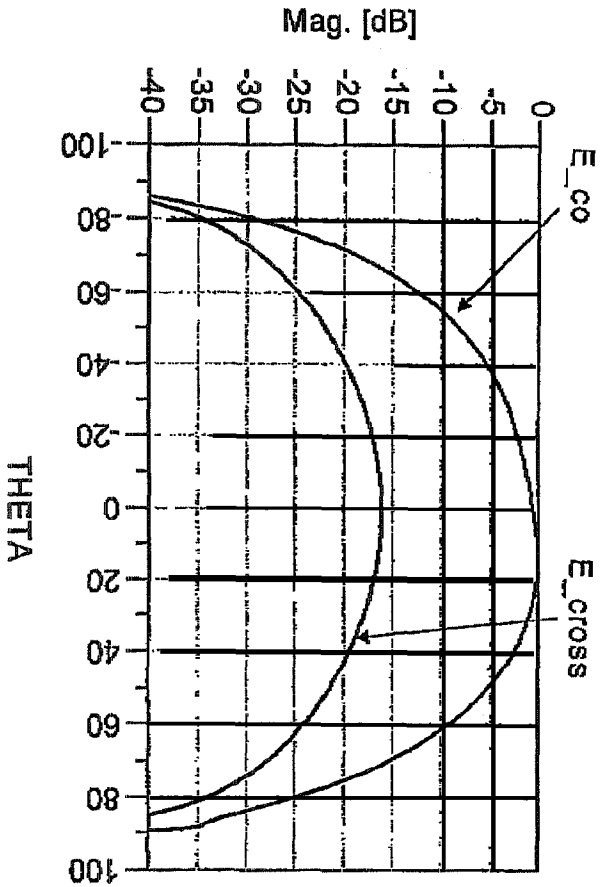
FIGS. 10*a-b* show simulations for a prior art antenna element (a), and for an antenna element according to the present invention (b).
Figure 10B:
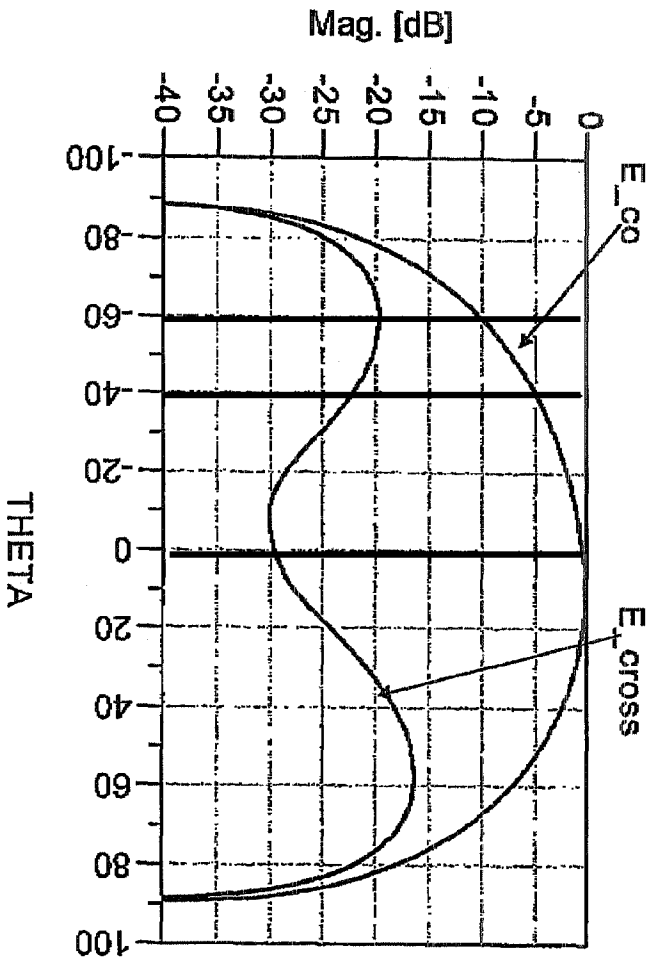

FIGS. 8-10 show simulations of coupling, reflection and radiation patterns for a dual polarised patch antenna element according to prior art and according to the present invention. FIGS. 8*a*, 9*a* and 10*a* show simulations for a prior art antenna, basically an antenna element as the one shown in FIG. 2. FIGS. 8*b*, 9*b*, and 10*b* show simulations for an antenna element according to the present invention, more specifically for an antenna element as the one shown in FIG. 4*c*, having a compensation line arranged between the feeders.

In these simulations, a microstrip line has been used as the compensation line 420, the microstrip line being implemented as a 0.5 mm wide line resulting in an impedance of 220Ω for the compensation line 420. The first and second feeders 205, 206, 405, 406 feeders here have an impedance of 50Ω. Thus, a current division between the 50Ω impedance of the first and second feeders 405, 406 and the 220Ω impedance of the compensation line 420 will take place in the antenna element according to the present invention.

As can be seen in FIGS. 8*a* and 8*b*, the mutual coupling 830 is much lower for the antenna element of the present invention (shown in FIG. 8*b*), as for the prior art antenna element (shown in FIG. 8*a*). Note here that the two diagrams have differing scales. The antenna element of the present invention thus has a coupling being around 30 dB between the feeder ports. Also, the reflection 840 is more or less similar for the prior art antenna element and the antenna element of the present invention.

Further, FIGS. 9*a* and 9*b* show a simulated radiation pattern at 2000 MHz for the azimuth plane (ϕ=0° in the coordinate system shown in FIG. 4*c*) for the prior art antenna element (FIG. 9*a*) and for the antenna element of the present invention (FIG. 9*b*), both being simulated as having infinite ground planes.

As can be seen in FIGS. 9*a* and 9*b*, the cross polarisation, E_cross, is greatly improved for the antenna element according to the present invention (FIG. 9*b*), as compared to the prior art antenna element (FIG. 9*a*). For the present invention, the level of the cross polarisation is 30 dB on the z-axis (THETA=0), which is very desirable. THETA is here defined as the angle from a z-axis being perpendicular to both the x-axis and y axis in the system of coordinates defined in FIG. 4*c*.

The radiation pattern in the direction of the polarisation, E_co, is very similar for both the prior art antenna element (FIG. 9*a*) and for the antenna element of the present invention (FIG. 9*b*). This tells us that that we have not deteriorated that characteristic of the radiation at the same time as we have gained a lot for the cross polarisation.

FIGS. 10*a* and 10*b* show a simulated radiation pattern at 2000 MHz for the E-plane (ϕ=45° in the coordinate system shown in FIG. 4*c*) for the prior art antenna element (FIG. 10*a*), and for the antenna element of the present invention (FIG. 10*b*), both being simulated as having infinite ground planes.

As for the azimuth plane, it can be seen in FIGS. 10*a* and 10*b*, that the cross polarisation, E_cross, is greatly improved for the antenna element according to the present invention, as compared to the prior art antenna element. A very good isolation level of 30 dB on the z-axis (THETA=0) for the cross polarisation is here also achieved for the present invention.

The radiation pattern in the direction of the polarisation, E_co, is also here not deteriorated by the compensation line of the present invention.

Further, in corresponding simulations for an antenna array, including two antenna elements according to the present invention, the coupling isolation (E_cross) for the radiation pattern for the antenna array has shown to be more than 23 dB.

The invention claimed is:

1. A dual polarized antenna element, including:

a first feeder for feeding said antenna element in a first polarization direction, and a second feeder for feeding said antenna element in a second polarization direction, wherein a compensation line is arranged between said first and said second feeders for compensating for an imbalance caused by an essentially capacitive coupling between said first and second feeders, where said compensation line is connected to said first and second feeders in close proximity to a radiating part of said antenna element, and has a short electrical length θ and a high impedance relative to an impedance of the first and second feeders, respectively, thereby giving said compensation line an essentially inductive character; and wherein said compensation line has an impedance being at least twice as high as an impedance for the first and second feeders, respectively.

2. The dual polarized antenna element as claimed in claim 1, wherein said compensation line has an electrical length θ being less than 2π/3 rad, θ<2π/3 rad.

3. The dual polarized antenna element as claimed in claim 1, wherein said dual polarized antenna element is provided with any one of the antenna element isolation techniques in the group: parasitic impedance(s), shield wall(s), asymmetrical patch, rectangular patch, diagonal apertures, shifted feed position(s).

4. The dual polarized antenna element as claimed in claim 1, wherein said compensation line is connected to said first feeder at a first distance $D_1$ from said radiating part and to said second feeder at a second distance $D_2$ from said radiating part, wherein said first and second distances are very short relative to the wavelength of the transmitted signal.

5. The dual polarized antenna element as claimed in claim 4, wherein said first and second distances $D_1$, $D_2$ are much less than half of the wavelength of the transmitted signal, $D_1 \ll \lambda/2$ and $D_2 \ll \lambda/2$, and preferably much less than a quarter of the wavelength of the transmitted signal, $D_1 \ll \lambda/4$ and $D_2 \ll \lambda/4$.

6. An antenna array wherein said antenna array includes at least two dual polarized antenna elements as defined in claim 1.

7. A dual polarized antenna element including:

a first feeder for feeding said antenna element in a first polarization direction, and a second feeder for feeding said antenna element in a second polarization direction, wherein a compensation line is arranged between said first and said second feeders for compensating for an imbalance caused by an essentially capacitive coupling between said first and second feeders, where said compensation line is connected to said first and second feeders in close proximity to a radiating part of said antenna element, and has a short electrical length θ and a high impedance relative to an impedance of the first and second feeders, respectively, thereby giving said compensation line an essentially inductive character; and wherein said essentially capacitive coupling and said compensation line together, from a feeder input port point of view, form a parallel resonance circuit.

8. A dual polarized antenna element including:

a first feeder for feeding said antenna element in a first polarization direction, and a second feeder for feeding said antenna element in a second polarization direction, wherein a compensation line is arranged between said first and said second feeders for compensating for an imbalance caused by an essentially capacitive coupling between said first and second feeders, where said compensation line is connected to said first and second feeders in close proximity to a radiating part of said antenna element, and has a short electrical length θ and a high impedance relative to an impedance of the first and second feeders, respectively, thereby giving said compensation line an essentially inductive character; and wherein said essentially capacitive coupling includes at least a capacitive coupling between at least one of said first and second feeders and said radiating part of said antenna element.

9. A dual polarized antenna element including:

a first feeder for feeding said antenna element in a first polarization direction, and a second feeder for feeding said antenna element in a second polarization direction, wherein a compensation line is arranged between said first and said second feeders for compensating for an imbalance caused by an essentially capacitive coupling between said first and second feeders, where said compensation line is connected to said first and second feeders in close proximity to a radiating part of said antenna element, and has a short electrical length θ and a high impedance relative to an impedance of the first and second feeders, respectively, thereby giving said compensation line an essentially inductive character, wherein said essentially capacitive coupling includes a capacitive coupling between said first and second feeders in at least one point where said first and second feeders are close to each other, and wherein said dual polarized antenna element is an aperture coupled patch antenna element, in which said first feeder includes a first pair of feed lines extending in parallel along a first aperture slot, on each side thereof, and said second feeder includes a second pair of feed lines extending in parallel along a second aperture slot, on each side thereof, where said first and second pair of feed lines cross each other in said at least one point, at a mutual distance.

10. The dual polarized antenna element as claimed in claim 9, wherein said first and second feeders cross each other in an air-bridge.

* * * * *